US006796640B2

(12) United States Patent
Miyata

(10) Patent No.: US 6,796,640 B2
(45) Date of Patent: Sep. 28, 2004

(54) LIQUID-JET HEAD AND LIQUID-JET APPARATUS

(75) Inventor: Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 10/319,824

(22) Filed: Dec. 16, 2002

(65) Prior Publication Data

US 2003/0117464 A1 Jun. 26, 2003

(30) Foreign Application Priority Data

Dec. 20, 2001 (JP) ..... 2001-388355
Dec. 16, 2002 (JP) ..... 2002-363644

(51) Int. Cl.[7] ..... B41J 2/045
(52) U.S. Cl. ..... 347/71
(58) Field of Search ..... 347/68, 70, 71; 29/890.1; 310/328

(56) References Cited

U.S. PATENT DOCUMENTS 6,390,602 B1 * 5/2002 Katakura et al. ..... 347/50
6,502,930 B1 * 1/2003 Shimada et al. ..... 347/71

* cited by examiner

*Primary Examiner*—Judy Nguyen
(74) *Attorney, Agent, or Firm*—Sughrue Mion, PLLC

(57) ABSTRACT

Disclosed are a liquid-jet head that is capable of arraying pressure generating chambers in high density and achieving miniaturization thereof and a liquid-jet apparatus. In the liquid-jet head, a joining plate 30 joined onto piezoelectric elements 300 side of a passage-forming substrate 10 are provided, on which a drive circuit 110 for driving the piezoelectric elements 300 is mounted, a penetrated hole 33 penetrating the joining plate 30 in a thickness direction is provided in a portion corresponding to a space between rows of pressure generating chambers 12 of the joining plate 30, extracted wirings 90 extracted from individual piezoelectric elements 300 are extended to a portion corresponding to the penetrated hole 33, and the extracted wirings 90 and a drive circuit 110 are electrically connected to each other with conductive wires 120 extended through the penetrated hole 33. Thus, the area of the penetrated hole 33 is suppressed to be small.

7 Claims, 7 Drawing Sheets

LIQUID-JET HEAD AND LIQUID-JET APPARATUS

BACKGROUND OF THE INVENTION

1. Field of the Invention

The present invention relates to a liquid-jet head, in which pressure generating chambers that communicate with nozzle orifices ejecting liquid droplets are partially constituted by vibration plates, piezoelectric elements which are provided above the pressure generating chambers having the vibration plates interposed therebetween, and the liquid droplets are ejected with the displacement of the piezoelectric elements, and relates to a liquid-jet apparatus. More particularly, the present invention relates to an ink-jet recording head that ejects ink as the liquid and to an ink-jet recording apparatus.

2. Description of the Related Art

Two methods ate put into practical use in an ink-jet recording head, in which pressure generating chambers that communicate with nozzle orifices ejecting ink droplets are partially constituted of vibration plates, these vibration plates are deformed by piezoelectric elements to pressurize ink in the pressure generating chambers, and the ink droplets are ejected from the nozzle orifices. One is a recording head that uses piezoelectric actuators of a longitudinal vibration mode, which expand and contract in the axis direction of the piezoelectric elements, and the other is a recording head that uses piezoelectric actuators of a flexural vibration mode.

In the former, a volume of each pressure generating chamber can be changed by abutting the end surface of the piezoelectric element against the vibration plate, thus enabling manufacturing of a head suitable to high density printing. On the contrary, while possible, a difficult process is required in cutting and dividing the piezoelectric element in a comb tooth shape in accordance with the array pitch of the nozzle orifices and work of positioning and fixing the cut and divided piezoelectric elements to the pressure generating chambers. Thus, there is a problem of a complex manufacturing process.

On the other hand, in the latter, the piezoelectric elements can be fabricated and installed on the vibration plate by a relatively simple process of adhering a green sheet of a piezoelectric material while fitting a shape thereof to that of the pressure generating chambers and baking the green sheet. However, a certain area of the vibration plate is required due to use of the flexural vibration, and thus there is a problem that a high density array of the piezoelectric elements is difficult.

Meanwhile, in order to solve such a disadvantage of the latter recording head, a recording head is proposed, in which an even piezoelectric material layer is formed over the entire surface of the vibration plate by a deposition technology, the piezoelectric material layer is divided into a shape corresponding to that of pressure generating chambers by a lithography method, and piezoelectric elements are formed so as to be independent of one another for each pressure generating chamber (refer to, for example, Japanese Patent Laid-Open No. Hei 5(1993)-286131, FIG. 3, Paragraph (0013)).

As a structure of such an ink-jet recording head as described above, a structure has been known, which includes: a passage-forming substrate having at least two rows of pressure generating chambers communicating with nozzle orifices; and a joining plate joined to a piezoelectric element side of the passage-forming substrate, on which a drive circuit for driving piezoelectric elements is mounted, wherein the piezoelectric elements are electrically connected to the drive circuit through penetrated holes provided in the joining plate (refer to, for example, Japanese Patent Laid-Open No. 2000-296616, FIG. 20, Paragraph (0161) to (0163)).

Specifically, in such an ink-jet recording head as described above, two rows of the piezoelectric elements 202 are provided in regions corresponding to the rows of the pressure generating chambers 201 as shown in FIG. 7. Moreover, each piezoelectric element 202 is extended from a region opposing the pressure generating chamber 201 to the peripheral wall of the reservoir 203 and is sandwiched between the passage-forming substrate 204 and the reservoir-forming plate (joining plate) 205. Furthermore, the penetrated holes 206 are provided for each row of the pressure generating chambers 201 on the reservoir 203 sides of the reservoir-forming plate 205, that is, in regions opposing the peripheral walls of the pressure generating chambers 201. Then, the drive circuit 207 mounted on the approximate center portion of the reservoir-forming plate 205, that is, on a region corresponding to a space between the rows of the piezoelectric elements 202, is electrically connected to the respective piezoelectric elements 202 through the penetrated holes 206 provided individually on both sides of the drive circuit 207 by the bonding wires 208.

SUMMARY OF THE INVENTION

However, though the manufacturing cost of the conventional ink-jet recording head is controlled to be relatively low since the recording head is constructed to drive two rows of the piezoelectric elements with one drive circuit, the following problem is inherent therein. The penetrated holes are formed individually on the both sides of the drive circuit, which cause the necessity of making the passage-forming substrate and the joining plate relatively large, and cause a difficulty in the miniaturization of the head, Particularly, when the head is attempted to be miniaturized by arraying the pressure generating chambers in high density, there is a problem of difficulty in securing regions where the plurality of penetrated holes are formed.

Note that such a problem as described above needless to say occurs in other liquid-jet heads ejecting liquids other than ink, similarly to the ink-jet recording head ejecting ink.

In consideration of such circumstances as described above, it is an object of the present invention to provide a liquid-jet head that is capable of arraying the pressure generating chambers in high density and achieving miniaturization thereof.

A first aspect of the present invention that attains the foregoing object is a liquid-jet head comprising: a passage-forming substrate including at least two rows of pressure generating chambers communicating with a nozzle orifice and being defined by a plurality of compartment walls; and piezoelectric elements composed of a lower electrode, a piezoelectric layer and an upper electrode, the piezoelectric element being provided on one surface side of the passage-forming substrate with vibration plates interposed therebetween, characterized in that a joining plate joined onto the piezoelectric element side of the passage-forming substrate is provided, on which a drive circuit for driving the piezoelectric elements is mounted, a penetrated hole penetrating the joining plate in a thickness direction is provided in a portion corresponding to a space between the rows of the pressure generating chambers of the joining plate, an extracted wiring extracted from individual the piezoelectric elements is extended to the portion corresponding to the penetrated hole, and the extracted wiring and the drive circuit are electrically connected to each other with conductive wires extended through the penetrated hole.

In the first aspect, the region where the penetrated hole is formed can be reduced, and therefore, the pressure generating chambers can be arrayed in high density, and the head can surely be miniaturized.

A second aspect of the present invention is the liquid-jet head according to the first aspect, in which the plurality of drive circuits for driving the piezoelectric elements individually for each of the rows of the pressure generating chambers are provided, and the drive circuits are mounted on both sides of the penetrated hole.

In the second aspect, the drive circuits and the extracted wiring can be connected relatively easily to each other with the connection wiring, and manufacturing cost thereof can be suppressed relatively low.

A third aspect of the present invention is the liquid-jet head according to any one of the first and second aspects, in which the joining plate includes a piezoelectric element holding portion for hermetically sealing a space secured in a region facing towards the piezoelectric elements.

In the third aspect, the breakage of the piezoelectric elements due to an external environment is prevented.

A fourth aspect of the present invention is the liquid-jet head according to any one of the first to third aspects, in which the joining plate includes a reservoir portion constituting at least a part of a liquid chamber common to the pressure generating chambers.

In the fourth aspect, the joining plate also serves as a reservoir-forming plate, and therefore, it is not necessary to provide the reservoir-forming plate separately, and the head can be miniaturized.

A fifth aspect of the present invention is the liquid-jet head according to any one of the first to fourth aspects, in which the drive circuit is a semiconductor integrated circuit.

In the fifth aspect, the drive circuit can be mounted on the joining plate relatively easily.

A sixth aspect of the present invention is the liquid-jet head according to any one of the first to, fifth aspects, in which the pressure generating chambers are formed by anisotropic etching for a single crystal silicon substrate, and each layer of the piezoelectric element is formed by deposition and lithography methods.

In the sixth aspect, the large amount of the liquid-jet heads having high-density nozzle orifices can be manufactured relatively easily.

A seventh aspect of the present invention is a liquid-jet apparatus comprising the liquid-jet head according to any one of the first to sixth aspects.

In the seventh aspect, a liquid-jet apparatus can be realized, in which jet density of liquid droplets is improved, and miniaturization is achieved.

DESCRIPTION OF THE PREFERRED EMBODIMENTS

The present invention will be described below in detail based on embodiments.

Embodiment 1

Figure 1:
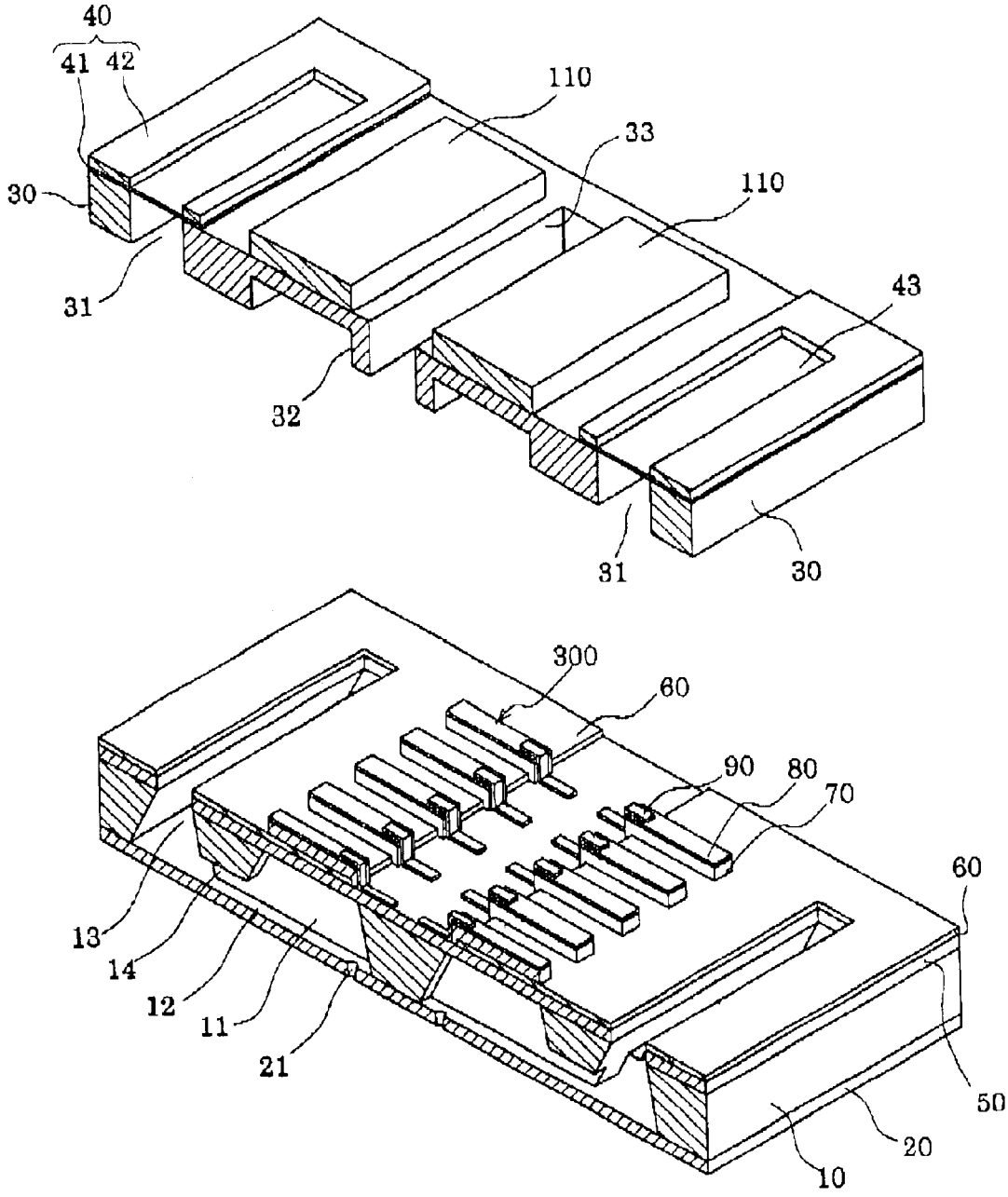
FIG. 1 is an exploded perspective view of a recording head according to Embodiment 1.
Figure 2A:
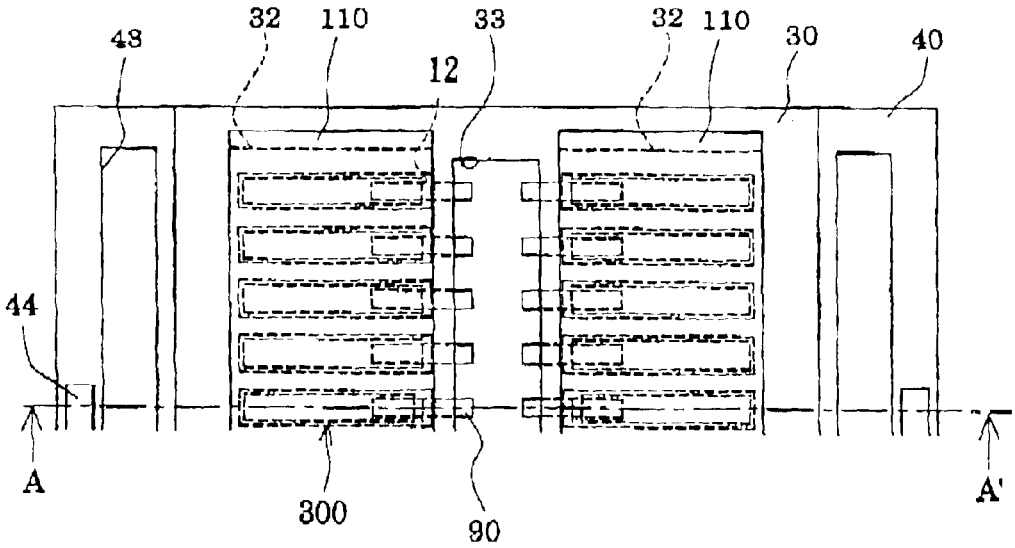
FIGS. 2A and 2B are plan and cross-sectional views of the recording head according to Embodiment 1, respectively.
Figure 2B:
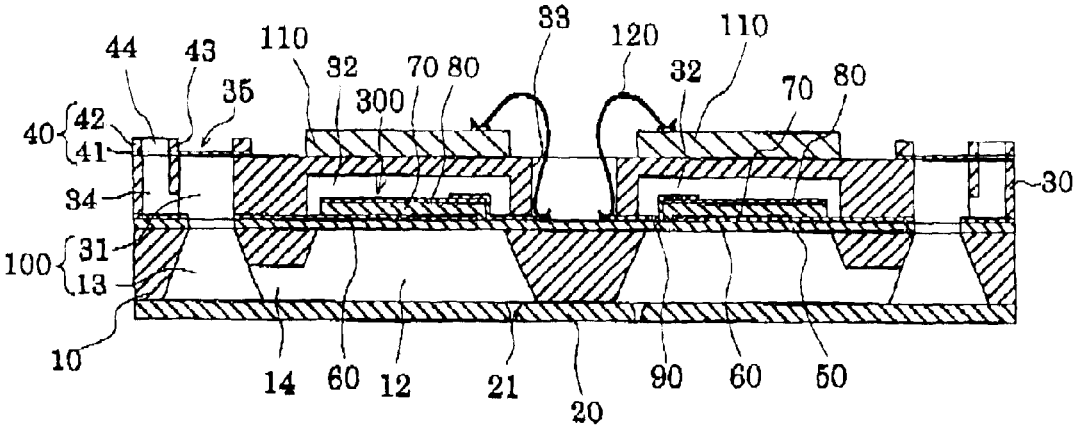

FIG. 1 is an exploded perspective view showing an ink-jet recording head according to Embodiment 1 of the present invention, and FIGS. 2A and 2B are plan and cross-sectional views of FIG. 1, respectively.

As illustrated in FIG. 1, the passage-forming substrate 10 is composed of a single crystal silicon substrate of a plane orientation (110) in this embodiment. One surface of the passage-forming substrate 10 becomes an opening surface, and on the other surface, elastic film 50 having a thickness ranging from 1 to 2 $\mu$m is formed, which is made of silicon dioxide formed by thermal oxidation in advance.

Meanwhile, on the opening surface of the passage-forming substrate 10, two rows of the pressure generating chambers 12 partitioned by the plurality of compartment walls 11 are provided parallel in the width direction by carrying out anisotropic etching for the single crystal silicon substrate. On the outside in the longitudinal direction, the communicating portions 13 that partially constitute the reservoirs 100 are formed, the reservoirs 100 communicating with the reservoir portions 31 in the reservoir-forming plate 30 to be described later and serving as common ink chambers to the respective pressure generating chambers 12. The communicating portions 13 are made to communicate individually with one end of the pressure generating chambers 12 in the longitudinal direction through the ink supply paths 14.

Here, the anisotropic etching is carried out by utilizing a difference in etching rate of the single crystal silicon substrate. For example, in this embodiment, the anisotropic etching is carried out by utilizing the following property of the single crystal silicon substrate. When the single crystal silicon substrate is immersed in an alkaline solution such as KOH, it is gradually eroded, and there emerge the first (111) plane perpendicular to the (110) plane and the second (111) plane forming an angle of about 70 degrees to the first (111) plane and an angle of about 35 degrees to the above-described (110) plane. As compared with the etching rate of the (110) plane, the etching rate of the (111) plane is about 1/180. With such anisotropic etching, it is possible to perform high-precision processing based on depth processing in a parallelogram shape formed of two of the first (111) planes and two of the second (111) planes slant thereto, so that the pressure generating chambers 12 can be arrayed in high density.

In this embodiment, the long sides of the respective pressure generating chambers 12 are formed of the first (111) planes, and the short sides thereof are formed of the second (111) planes. These pressure generating chambers 12 are formed by carrying out etching through the passage-forming substrate 10 and almost reaching the elastic film 50. Here, the elastic film 50 is eroded extremely little by the alkaline solution used for etching the single crystal silicon substrate.

Moreover, the respective ink supply paths 14 communicating with one ends of the pressure generating chambers 12 are formed to be shallower than the pressure generating chambers 12, so that passage resistance of ink flowing into the pressure generating chambers 12 is maintained constant. Specifically, the ink supply paths 14 are formed by etching the single crystal silicon substrate partway in the thickness direction (half-etching) Note that the half-etching is carried out by adjusting an etching time.

With regard to the thickness of the passage-forming substrate 10 as described above, the optimal thickness may be satisfactorily selected in accordance with the array density of the pressure generating chambers 12. For example, if the array density is set at about 180 dots per inch (180 dpi), then the thickness of about 220 $\mu$m is satisfactory for the passage-forming substrate 10. If the pressure generating chambers 12 are arrayed in a relatively high density of 200 dpi or more, then it is preferable that the thickness of the passage-forming substrate 10 be made relatively thin, that is, 100 $\mu$m or less. This is because the array density can be increased while maintaining the rigidity of each compartment wall 11 between the pressure generating chambers 12 neighboring each other.

On the opening surface side of the passage-forming substrate 10, the nozzle plate 20 in which the nozzle orifices 21 are drilled is fixedly adhered via an adhesive agent or a thermowelding film, each nozzle orifice 21 communicating with the pressure generating chamber 12 at a spot opposite to the ink supply path 14. Note that the nozzle plate 20 is made of glass ceramics, stainless steel or the like having a thickness of, for example, 0.1 to 1 mm and a linear expansion coefficient of, for example, 2.5 to 4.5 [$\times 10^{-6}$/° C.] at a temperature of 300° C. or lower. The nozzle plate 20 entirely covers one surface of the passage-forming substrate 10 and plays a role of a reinforcement plate for protecting the single crystal silicon substrate from an impact or an external force. Moreover, the nozzle plate 20 may be formed of a material having a thermal expansion coefficient approximately equal to that of the passage-forming substrate 10. In this case, the passage-forming substrate 10 and the nozzle plate 20 can be joined together easily by use of a thermosetting adhesive agent and the like since deformations of the passage-forming substrate 10 and the nozzle plate 20 due to heat are approximately the same.

Here, the size of the pressure generating chambers 12 that give ink droplet ejection pressures to ink and the size of the nozzle orifices 21 that eject ink droplets are optimized in accordance with an amount of ink droplets to be ejected, an ejection speed thereof, an ejection frequency thereof and the like. For example, in the case where 360 dots of ink droplets per inch are recorded, it is necessary that the nozzle orifices 21 be formed precisely with a diameter of several dozen micrometers.

Meanwhile, on the elastic film 50 at the opposing side of the opening surface of the passage-forming substrate 10, the lower electrode films 60 having a thickness of, for example, about 0.2 $\mu$m, the piezoelectric layers 70 having a thickness of, for example, about 1 $\mu$m, and the upper electrode films 80 having a thickness of, for example, about 0.1 $\mu$m are formed in a stacked state in a process to be described later, thus constituting the piezoelectric elements 300. Here, each piezoelectric element 300 means a portion including the lower electrode film 60, the piezoelectric layer 70 and the upper electrode film 80. In general, the piezoelectric element 300 is constituted such that any one of electrodes thereof is made to be a common electrode, and that the other electrode and the piezoelectric layer 70 are patterned for each pressure generating chamber 12. Here, a portion, which is constituted of the patterned one of electrodes and the patterned piezoelectric layer 70, and where a piezoelectric strain is generated by application of a voltage to both of the electrodes, is referred to as a piezoelectric active portion. In this embodiment, the lower electrode films 60 are made to be common electrodes to the piezoelectric elements 300, and the upper electrode film 80 is made to be an individual electrode of each piezoelectric element 300. However, no impediment occurs even if the above-described order is reversed for the convenience of a drive circuit and wiring. In any of the cases, the piezoelectric active portion will be formed for each pressure generating chamber. In addition, here, a combination of the piezoelectric element 300 and a vibration plate in which displacement occurs due to the drive of the piezoelectric element 300 is referred to as a piezoelectric actuator.

Moreover, the lead electrodes 90 made of, for example, gold (Au) for connecting the piezoelectric elements 300 as described above to the drive circuits 110 are formed as extracted wiring on the piezoelectric elements 300. Specifically, each lead electrode 90 is extended from the vicinity of the end portion of the upper electrode film 80 on the inner side of the row of the pressure generating chambers 12 onto the elastic film 50.

Although details are described later, each lead electrode 90 is extended to a region facing to the penetrated hole 33 of the reservoir-forming plate 30, and the vicinity of the end portion of the lead electrode 90 is electrically connected to the drive circuit 110 with connection wiring extended through the penetrated hole 33.

The reservoir-forming plate 30 that is a joining plate having the reservoir portions 31 constituting at least a part of the reservoirs 100 is joined onto the passage-forming substrate 10 on which the piezoelectric elements 300 as described above are formed. In this embodiment, these reservoir portions 31 are formed over the width direction of the pressure generating chambers 12 in a manner of penetrating the reservoir-forming plate 30 in the thickness direction. As described above, the reservoir portions 31 are made to communicate with the communicating portions 13 of the passage-forming substrate 10, thus constituting the reservoirs 100 serving as ink chambers common to the pressure generating chambers 12.

Moreover, the piezoelectric element holding portions 32 capable of hermetically sealing spaces secured so as not to hinder the movements of the piezoelectric elements 300 are provided on the regions of the reservoir-forming plate 30, which face towards the piezoelectric-elements 300, so as to correspond to the pressure generating chambers 12. The piezoelectric elements 300 are hermetically sealed in the respective piezoelectric element holding portions 32. Although the piezoelectric element holding portions 32 are provided for each row of the piezoelectric elements 300 in this embodiment, the piezoelectric element holding portions 32 may be provided independently for each piezoelectric element 300.

For the reservoir-forming plate 30, it is preferable to use a material having a thermal expansion coefficient approximately equal to that of the passage-forming substrate 10, for example, a glass material, a ceramic material and the like. In this embodiment, a single crystal silicon substrate that is the same as that for the passage-forming substrate 10 is used to form the reservoir-forming plate 30.

Moreover, the penetrated hole 33 penetrating the reservoir-forming plate 30 in the thickness direction is provided in the approximately center portion of the reservoir-forming plate 30, that is, in the region facing towards the space between the rows of the pressure generating chambers 12. Then, as described above, the lead electrodes 90 extended from the piezoelectric elements 300 are extended to the region facing to the penetrated hole 33, and the vicinities of the end portions of the lead electrodes 90 are exposed thereto.

Moreover, the drive circuits 110 such as, for example, circuit boards and semiconductor integrated circuits (ICs), for driving the respective piezoelectric elements 300, are mounted individually on the both sides of the penetrated hole 33 of the reservoir-forming plate 30, that is, on the portions corresponding to each of the rows of the pressure generating chambers 12. For example, the drive circuits 110 mounted on the both sides of the penetrated holes 33 are used for driving the piezoelectric elements 300 provided in the regions opposing the respective drive circuits 110 in this embodiment.

Then, each of the drive circuits 110 is electrically connected to the lead electrodes 90 extended from the piezoelectric elements 300 individually with the connection wiring 120 composed of conductive wires such as, for example, bonding wires (refer to FIG. 2B).

As described above, in this embodiment, one penetrated hole 33 is provided in the region of the reservoir-forming plate 30, which faces towards the space between the rows of the pressure generating chambers 12, and the lead electrodes 90 extended from the piezoelectric elements 300 are electrically connected to the drive circuits 110 with the connection wiring 120 extended through the penetrated hole 33. Therefore, the area of the reservoir-forming plate 30, where the penetrated hole 33 is formed, can be reduced. Specifically, a ratio of the penetrated hole 33 to the entire surface of the reservoir-forming plate 30 can be reduced. Moreover, the manufacturing efficiency of the head can be improved since the drive circuits 110 and the lead electrodes 90 are electrically connected to each other through one penetrated hole 33.

Accordingly, even if the pressure generating chambers 12 are arrayed in relatively high density, the penetrated hole 33 can be formed without enlarging the passage-forming substrate 10 and the reservoir-forming plate 30, and an ink-jet recording head improving printing quality thereof and achieving miniaturization thereof can be realized.

Note that, although the two drive circuits 110 have been mounted on both sides of the penetrated hole 33 of the reservoir-forming plate 30, the number of drive circuits 110 is not particularly limited, and for example, one drive circuit having a communicating hole communicating with the penetrated hole of the reservoir-forming plate may be mounted. Moreover, three or more drive circuits maybe mounted as a matter of course.

Furthermore, the number of penetrated holes is not limited to one, and two or more penetrated holes needless to say may be provided if the ratio of the penetrated holes to the entire surface of the reservoir-forming plate can be reduced.

Note that the compliance plates 40, each being composed of the sealing film 41 and the fixing plate 42, is joined onto the reservoir-forming plate 30 as described above. Here, the sealing films 41 are formed of a flexible material having low rigidity (for example, a polyphenylene sulfide (PPS) film having a thickness of 6 $\mu$m), and seal one surface of each of the reservoir portion 31. Moreover, the fixing plates 42 are formed of a hard material such as metal (for example, a stainless steel (SUS) having a thickness of 30 $\mu$m). The region of each fixing plate 42, which faces to the reservoir 100, is removed completely in the thickness direction to define the opening portion 43. Therefore, one surface of each reservoir 100 is sealed only by the flexible sealing film 41, thus defining the flexible portion 35 deformable by a change of inner pressure of the reservoir 100.

Moreover, the ink introducing ports 44 for supplying ink to the reservoirs 100 are formed on the compliance plates 40 on the outsides of the approximate center portions of the reservoirs 100 in the longitudinal direction. Furthermore, the ink introducing paths 34, each allowing the ink introducing port 44 and the sidewall of the reservoir 100 to communicate with each other, are provided in the reservoir-forming plate 30.

The ink-jet recoding head of this embodiment as described above takes in ink from the ink introducing ports 44 connected to unillustrated external ink supplying means, and fills, with ink, the inside thereof from the reservoirs 100 to the nozzle orifices 21. Then, the ink-jet recording head applies a voltage between the lower electrode film 60 and the upper electrode film 80, both of them corresponding to each pressure generating chamber 12, in accordance with a recording signal from the drive circuit 110. Thus, the ink-jet recording head allows the elastic film 50, the lower electrode films 60 and the piezoelectric layers 70 to undergo a flexural deformation. Accordingly, the pressure in the pressure generating chambers 12 is increased, and the ink droplets are ejected from the nozzle orifices 21.

Here, one example of the manufacturing method of the above-described ink-jet recording head in this embodiment will be described with reference to FIGS. 3A to 5C. Note that FIGS. 3A to 5C are cross-sectional views partially showing the longitudinal direction of the pressure generating chamber 12.

Figure 3A:
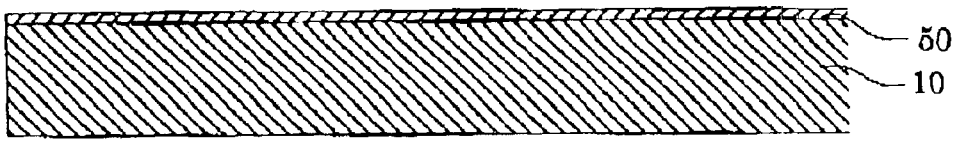
FIGS. 3A to 3D are cross-sectional views showing a manufacturing process of the recording head according to Embodiment 1.

First, as shown in FIG. 3A, a wafer of a single crystal silicon substrate that will be the passage-forming substrate 10 undergoes thermal oxidation in a diffusion furnace at a temperature of about 1100° C., and the elastic film 50 made of silicon dioxide is formed.

Figure 3B:
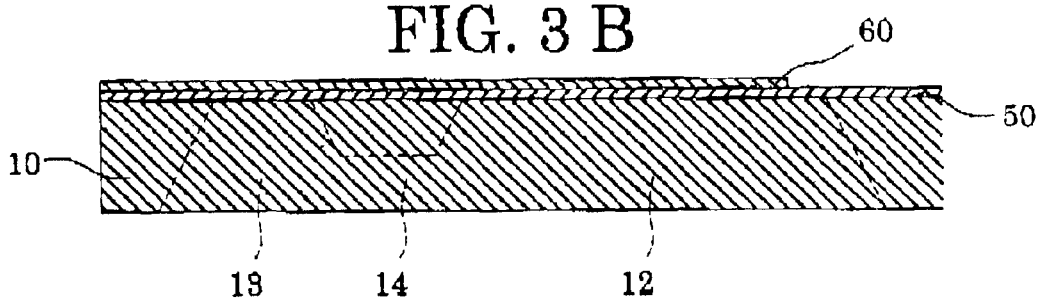

Next, as shown in FIG. 3B, the lower electrode film 60 is formed on the entire surface of the elastic film 50 by sputtering, and then the lower electrode film 60 is patterned to form the entire pattern. As a material of this lower electrode film 60, platinum (Pt) or the like is suitable. This is because it is necessary to crystallize the piezoelectric layer 70 to be described later, which is deposited by the sputtering method or the sol-gel method, by baking at a temperature ranging from 600 to 1000° C. under the atmosphere or an atmosphere of oxygen after the deposition. Specifically, it is essential that the material of the lower electrode film 60 can maintain conductivity thereof at such a high temperature under such an oxidation atmosphere. Particularly, in the case of using lead zirconate titanate (PZT) as the piezoelectric layer 70 it is desirable that a change in conductivity of the material caused by diffusion of lead oxide, be small. Platinum is suitable for these reasons.

Figure 3C:
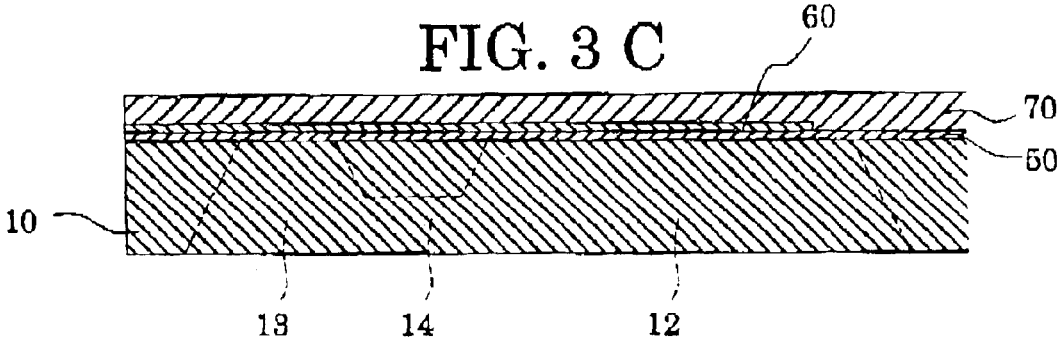

Next, as shown in FIG. 3C, the piezoelectric layer 70 is deposited. It is preferable that crystals of the piezoelectric layer 70 be oriented. For example, in this embodiment, a so-called sol-gel method is used, in which a so-called sol obtained by dissolving/dispersing metal organic matter in catalyst is coated and dried to turn the same into gel, the gel is further baked at a high temperature, and a layer made of metal oxide is formed. Thus, the piezoelectric layer 70 in which crystals are oriented is formed. Lead zirconate titanate series is suitable as a material of the piezoelectric layer 70, when the material is used for the ink-jet recording head. Note that the deposition method of this piezoelectric layer 70 is not particularly limited, and for example, the piezoelectric layer 70 may be formed by the sputtering method.

Furthermore, a method may be used, in which a precursor film of lead zirconate titanate (PZT) is formed by the sol-gel method or the sputtering method, and then the precursor film undergoes crystal growth at a low temperature by a high-pressure treatment method in an alkaline aqueous solution.

In any case, the piezoelectric film 70 thus deposited has crystal subjected to priority orientation unlike a bulk piezoelectric, and in this embodiment, the piezoelectric layer 70 has the crystals formed in a columnar shape. Note that the priority orientation indicates a state where the orientation direction of the crystals is not in disorder but specified crystal faces face in an approximately fixed direction. In addition, the thin film having crystals in a columnar shape indicates a state where the approximately columnar crystals gather across the surface direction in a state where the center axes thereof are made approximately coincident with the thickness direction. It is a matter of course that the piezoelectric layer 70 may be a thin film formed of particle-shaped crystals subjected to the priority orientation. Note that a thickness of the piezoelectric layer thus manufactured in the thin film step typically ranges from 0.2 to 5 $\mu$m.

Figure 3D:
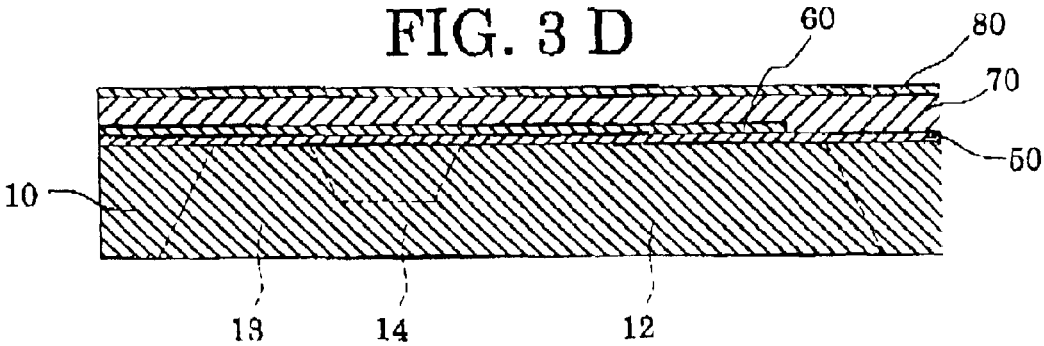

Next, as shown in FIG. 3D, the upper electrode film 80 is deposited.

Any material is satisfactory for the upper electrode film 80 as long as it has high conductivity, such as one of numerous metals, aluminum, gold, nickel, platinum, conductive oxide or the like. In this embodiment, platinum is deposited by sputtering.

Figure 4A:
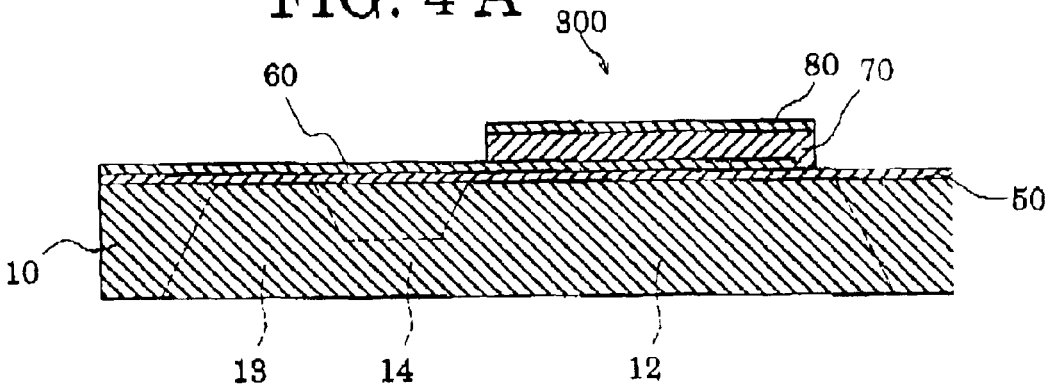
FIGS. 4A to 4C are cross-sectional views showing the manufacturing process of the recording head according to Embodiment 1.

Subsequently, as shown in FIG. 4A, only the piezoelectric layer 70 and the upper electrode film 80 are etched to pattern the piezoelectric element 300.

Figure 4B:
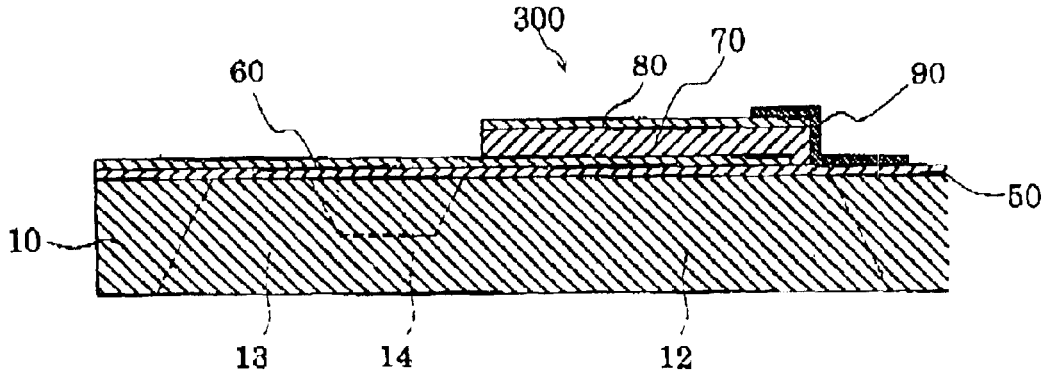

Next, as shown in FIG. 4B, the lead electrode 90 is formed. Concretely, for example, the lead electrode 90 made of gold (Au) or the like is formed over the entire surface of the passage-forming substrate 10 and patterned for each piezoelectric element 300.

Figure 4C:
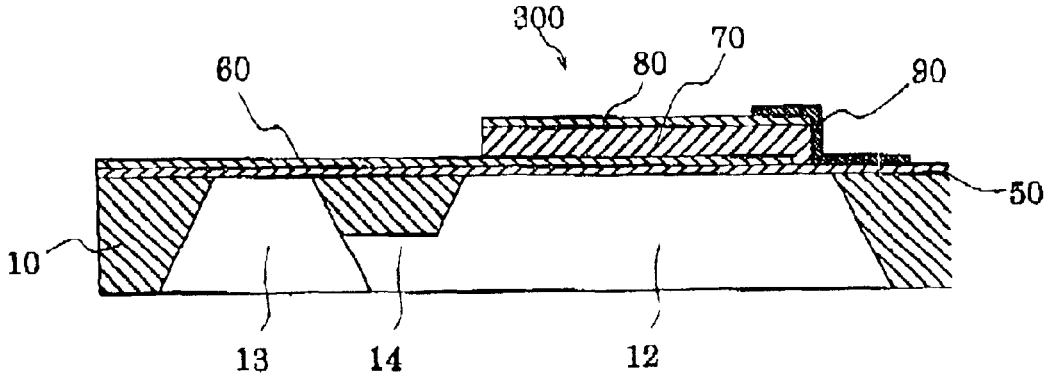

The film-forming process has been described as above. After the film is formed in such a manner, the above-described anisotropic etching is carried out for the single crystal silicon substrate by the alkaline solution. Thus, the pressure generating chamber 12, the communicating portion 13 and the ink supply path 14 are formed as shown in FIG. 4C.

Figure 5A:
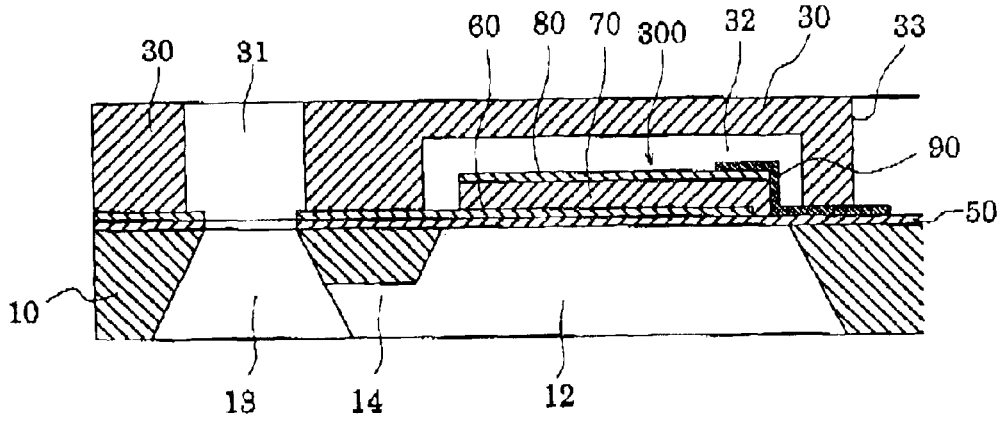
FIGS. 5A to 5C are cross-sectional views showing the manufacturing process of the recording head according to Embodiment 1.

Next, as shown in FIG. 5A, the reservoir-forming plate 30 and the passage-forming substrate 10 are joined together. In this case, the reservoir-forming plate 30 will be joined onto the passage-forming substrate 10 in a state where the respective lead electrodes 90 protrude into the penetrated hole 33 by a predetermined amount.

Figure 5B:
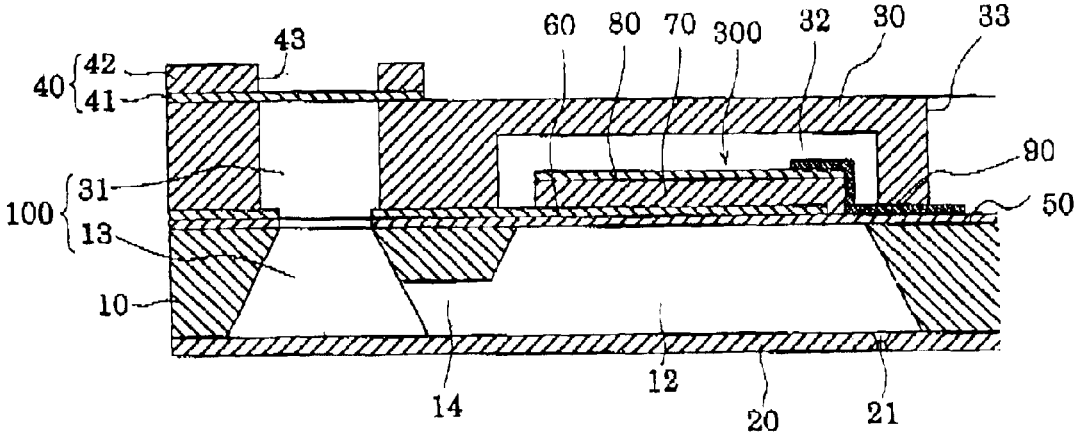

Subsequently, as shown in FIG. 5B, the nozzle plate 20 in which the nozzle orifices 21 are drilled is joined onto the surface of the passage-forming substrate 10, which is opposite to the reservoir-forming plate 30, and the compliance plate 40 is joined onto the reservoir-forming plate 30.

Figure 5C:
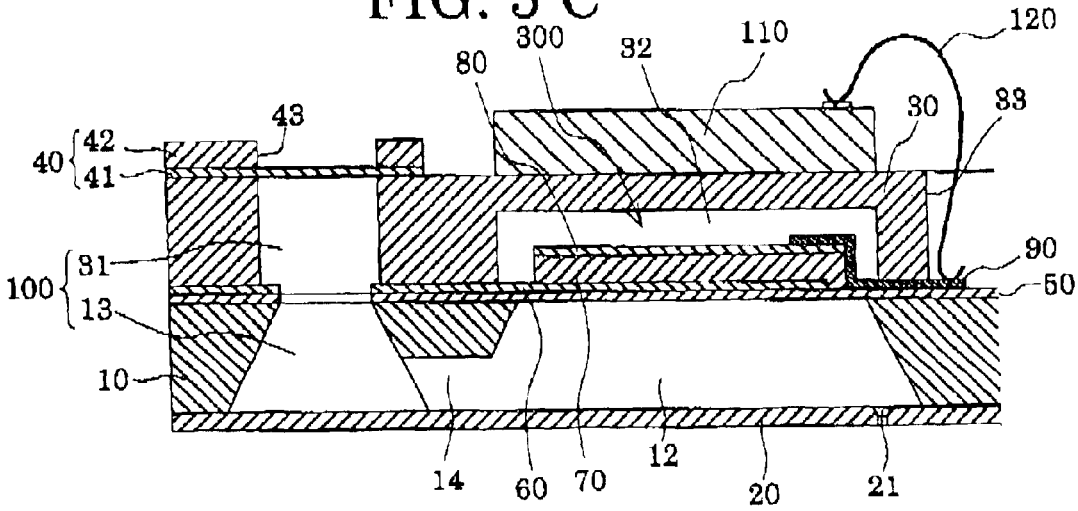

Thereafter, as shown in FIG. 5C, the drive circuits 110 for driving the piezoelectric elements 300 are mounted individually on the reservoir-forming plates 30 on both sides of the penetrated hole 33. Then, for example, the connection wiring 120 is formed by wire bonding or the like, and the drive circuits 110 are electrically connected to the lead electrodes 90 therethrough. Thus, the ink-jet recording head is manufactured.

Note that, actually, a large number of chips are simultaneously formed on one wafer by the above-described series of film formation and anisotropic etching, and after the process, the wafer is divided into a chip size for each passage-forming substrate 10 as shown in FIG. 1. Then, the reservoir-forming plate 30 and the compliance plate 40 are sequentially adhered onto the divided passage-forming substrate 10, all of which are then integrated together, thus forming the ink-jet recording head.

Other Embodiment

Although the present invention has been described above, the basic constitution of the ink-jet recording head is not limited to the one described above.

For example, though the ink-jet recording head of a thin film type, which is manufactured by applying the deposition and lithography processes, has been exemplified in the above-described embodiment, the present invention is not limited to this ink-jet recording head as a matter of course. For example, the present invention can be employed for an ink-jet recording head of a thick film type, which is formed by a method such as, for example, adhesion of a green sheet.

Figure 7:
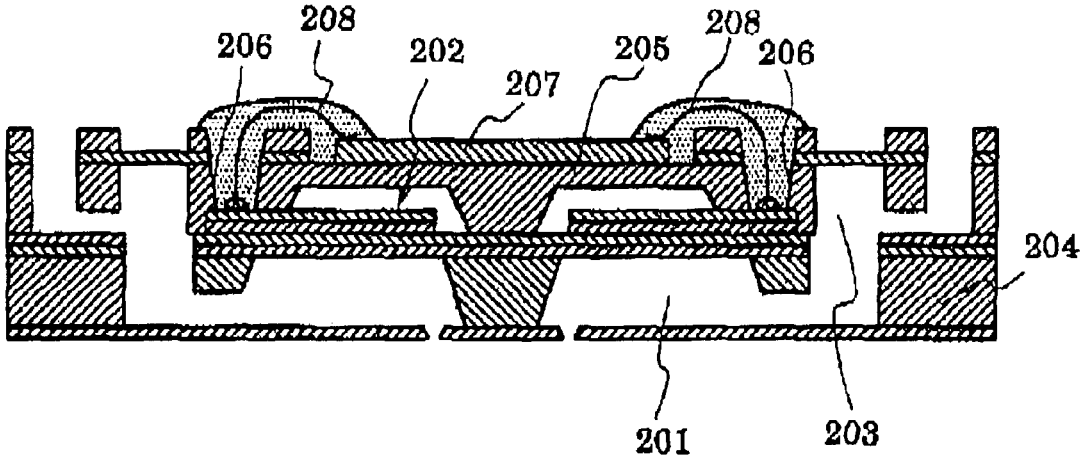
FIG. 7 PRIOR ART
FIG. 7 is a cross-sectional view of a recording head according to the prior art.

Moreover, the ink-jet recording head of this embodiment partially constitutes a recording head unit that is provided with an ink passage communicating with an ink cartridge or the like, and is mounted on an ink-jet recording apparatus. FIG. 7 is a schematic view showing an example of the ink-jet recording apparatus.

Figure 6:
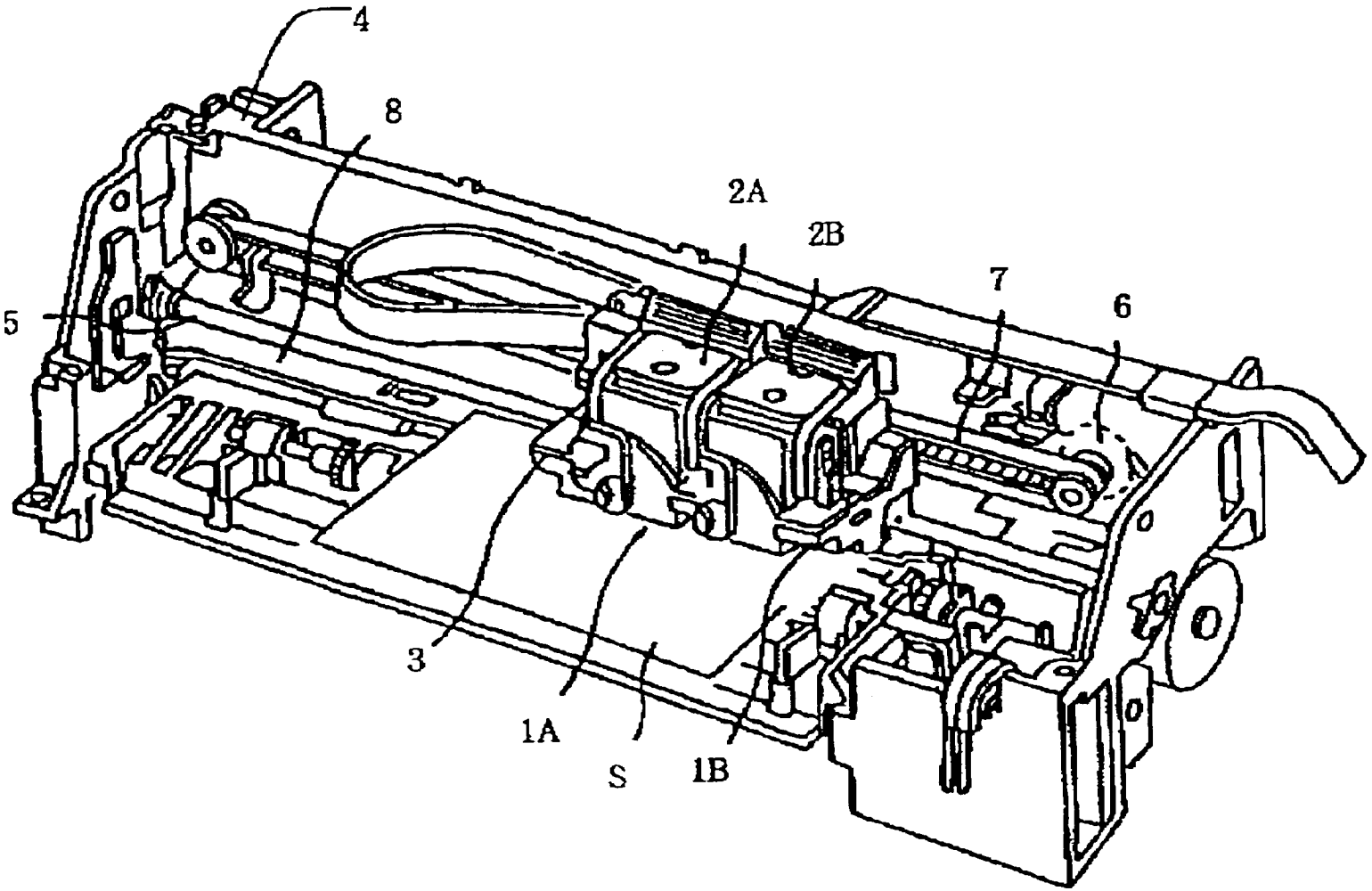
FIG. 6 is a schematic view of a recording apparatus according to one embodiment.

As shown in FIG. 6, in the recording head units 1A and 1B that have the ink-jet recording heads, the cartridges 2A and 2B constituting ink supplying means are detachably provided. The carriage 3 on which these recording head units 1A and 1B are mounted is provided on the carriage shaft 5 attached onto the apparatus body 4 so as to be freely movable in the shaft direction. These recording head units 1A and 1B are, for example, set to eject a black ink composition and a color ink composition, respectively.

Then, the drive force of the drive motor 6 is transmitted to the carriage 3 through a plurality of unillustrated gears and the timing belt 7, and thus the carriage 3 on which the recording head units 1A and 1B are mounted is moved along the carriage shaft 5. Meanwhile, the platen 8 is provided onto the apparatus body 4 along the carriage shaft 5. The recording sheet S as a recording medium such as paper fed by an unillustrated paper feed roller or the like is adapted to be conveyed on the platen 8.

Moreover, though the present invention has been described while exemplifying the ink-jet recording head that ejects ink as a liquid-jet head, the present invention is aimed to widely cover the overall liquid-jet heads and liquid-jet apparatuses. As such liquid-jet heads, for example, the following can be given: a recording head for use in an image recording apparatus such as a printer; a color-material-jet head for use in manufacturing a color filter of a liquid crystal display or the like; an electrode-material-jet head for use in forming electrodes of an organic EL display, an FED (field emission display) or the like; a bio-organic-material-jet head for use in manufacturing a biochip; and the like.

What is claimed is:

1. A liquid-jet head comprising:

a passage-forming substrate including at least two rows of pressure generating chambers communicating with nozzle orifices and being defined by a plurality of compartment walls; and piezoelectric elements each composed of a lower electrode, a piezoelectric layer and an upper electrode, the piezoelectric element being provided on one surface side of the passage-forming substrate with a vibration plate interposed therebetween, wherein a joining plate joined onto the piezoelectric element side of the passage-forming substrate is provided, on which a drive circuit for driving the piezoelectric elements is mounted, a penetrated hole penetrating the joining plate in a thickness direction is provided in a portion corresponding to a space between the rows of the pressure generating chambers, extracted wirings each extracted from a corresponding piezoelectric elements is extended to the portion corresponding to the penetrated hole, and the extracted wirings and the drive circuit are electrically connected to each other with conductive wires extended through the penetrated hole.

2. The liquid-jet head according to claim 1, wherein plurality of drive circuits for driving the piezoelectric elements individually for the rows of the pressure generating chambers are provided, and the drive circuits are mounted on both sides of the penetrated hole.

3. The liquid-jet head according to claim 1, wherein the joining plate includes a piezoelectric element holding portion for hermetically sealing a space secured in a region facing towards the piezoelectric elements.

4. The liquid-jet head according to claim 1, wherein the joining plate includes a reservoir portion constituting at least a part of a liquid chamber common to the pressure generating chambers of one row of said at least two rows.

5. The liquid-jet head according to claim 1, wherein the drive circuit is a semiconductor integrated circuit.

6. The liquid-jet head according to claim 1, wherein the pressure generating chambers are formed by anisotropic etching for a single crystal silicon substrate, and each layer of the piezoelectric elements is formed by deposition and lithography methods.

7. A liquid-jet apparatus comprising the liquid-jet head according to any one of claims 1 to 6.

* * * * *